US005964105A

United States Patent [19]

Nakamura

[11] Patent Number: 5,964,105

[45] Date of Patent: Oct. 12, 1999

[54] EARRING

[76] Inventor: Motonobu Nakamura, 1-18-39, Nishi-ohnuma, Sagamihara, Kanagawa-ken, Japan

[21] Appl. No.: 08/923,166

[22] Filed: Sep. 4, 1997

[30] Foreign Application Priority Data

Sep. 6, 1996 [JP] Japan ..... 8-257535
May 14, 1997 [JP] Japan ..... 9-139370

[51] Int. Cl.[6] ..... A44C 7/00

[52] U.S. Cl. ..... 63/14.1; 63/14.3; 63/14.2; 63/14.8

[58] Field of Search ..... 63/14.1, 14.3, 63/14.8, 14.2

[56] References Cited

U.S. PATENT DOCUMENTS

| | | | |
|---|---|---|---|
| 788,770 | 5/1905 | Hill et al. | 63/14.3 |
| 1,791,567 | 2/1931 | Meyer | 63/14.8 |
| 2,013,760 | 9/1935 | McSoley | 63/14.1 X |
| 2,389,295 | 11/1945 | Chernow | 63/14.8 |
| 2,510,511 | 6/1950 | Mittendorf | 63/14.3 |
| 2,802,249 | 8/1957 | Kulp | 63/14.1 X |
| 3,163,026 | 12/1964 | Kenny | 63/14.2 |
| 3,459,007 | 8/1969 | Whatley | 63/14.8 |
| 3,739,599 | 6/1973 | Melone | 63/14.3 |
| 4,590,775 | 5/1986 | Rivaud | 63/14.1 |
| 5,097,682 | 3/1992 | Nakamura | 63/14.1 |
| 5,146,768 | 9/1992 | Dichtel | 63/14.8 |

FOREIGN PATENT DOCUMENTS

| | | | |
|---|---|---|---|
| 153764 | 8/1951 | Australia | 63/14.8 |

OTHER PUBLICATIONS

Gordon's Jewelers catalog C6–5, front and rear covers and p. 12, Dec. 1986.

*Primary Examiner*—Terry Lee Melius
*Assistant Examiner*—Andrea Chop
*Attorney, Agent, or Firm*—Flynn, Thiel, Boutell & Tanis, P.C.

[57] ABSTRACT

Improved earrings which look beautiful in a right ear and a left ear including a connecting part coupling a first fastening part and a second fastening part of earrings is directed generally in the vertical direction and provided to grasp an earlobe, and the shape and/or direction of an ornamentation part and/or a fastener are adjusted to conform with the shape of the respective earlobe. Further, the improved earrings can be securely grasped to an earlobe without the wearer experiencing pain. The earring fastener includes a one-side fastener connected through a U-shaped part to the other-side fastener. The earring ornament is attached to one of the fasteners. One of the fasteners has a slip prevention surface with a large coefficient of friction to assist in securing the earring onto the earlobe. The earlobe is grasped between the fasteners.

5 Claims, 14 Drawing Sheets

EARRING

FIELD OF THE INVENTION

The present invention relates to an earring and more particularly to an earring wherein shape and direction of an ornamentation part and a fastener are varied in conformance with the shape of an earlobe, and to an earring which can be attached securely to an earlobe without increasing the grasping pressure due to a fastener, whereby beautiful appearance is improved, and pain in the earlobe due to grasping can be reduced.

BACKGROUND OF THE INVENTION

Personal ornaments, particularly ornaments for ears include a pierced earring to be attached to an earlobe through a pierced portion formed in the earlobe, an earring grasping the earlobe, and the like. Personal ornaments can also be attached to other parts of the body and to clothing. For an ornamentation part of a pierced earring or a grasping (i.e. clamping-type) earring, jewels such as a diamond, noble metals such as gold and platinum, or imitations such as a glass ball are used. Earrings can also be attached to an earlobe by a pushing and fixing means of screw type, a system of utilizing an energizing force of a spring or the like, or a combination of the pushing and fixing means of screw type and the system of utilizing the energizing force of a spring or the like.

The earlobes of right and left ears may be different from each other in rising angle with the front, or may be quite different between persons. Therefore, in the prior art as shown in FIG. 22, since a right-ear earring 102-1 and a left-ear earring 102-2 are designed so as to be in contact with earlobe surfaces of a right ear 104-1 and a left ear 104-2 respectively, the direction of ornamentation parts can not be selected. Consequently, it is difficult to make the earrings look beautiful when viewed from the front. Also the shape of some fasteners (not shown) of the earrings 102 cause inconvenience when the earrings can not be easily attached to or detached from the earlobes, or the earrings become a hindrance when clothes are put on or taken off.

Also as shown in FIGS. 23 to 24, in an earring 202 of ring type, a fastener 204 is divided into a first fastening part 204*a* and a second fastening part 204*b*, and a connecting part 206 couples the first fastening part 204*a* and the second fastening part 204*b* and also connects to a ring body 208 nearly at a right angle (90°).

As shown in FIGS. 25 to 28, when earrings 202 are respectively attached to a right earlobe 212-1 of a right ear 210-1 and a left earlobe 212-2 of a left ear 210-2, a right-ear earring 202-1 and a left-ear earring 202-2 look spread out viewed from the front, and there is the inconvenience that the beautiful appearance is reduced.

Some earrings have a personal ornament and a fastener including a one-side fastening part provided on one end of a substantially U-shaped connecting part and an other-side fastening part provided on the other end of the connecting part, and the ornament is attached at least to one of the one-side fastening part and the other-side fastening part, and an earlobe is grasped between the one-side fastening part and the other-side fastening part. In this earring, an interval between the one-side fastening part and the other-side fastening part provided respectively on both ends of the connecting part is formed in conformance with the thickness of the earlobe, whereby the earring is attached by grasping the earlobe between the one-side fastening part and the other-side fastening part.

However, the total weight or the position of the center of gravity of an earring is liable to be varied depending on shape and weight of a fastener and an ornament attached to the fastener. Therefore, in the earring, the attitude of the ornament must be held properly so that the beautiful appearance is not reduced when the earring is attached to the earlobe, and the grasping pressure on the earlobe by the one-side fastening part and the other-side fastening part of the fastener must be set properly so that the earring does not slip off the earlobe.

In order to properly hold the attitude of the ornament during attaching or in order to prevent the earring from slipping off, when the grasping pressure of the one-side fastening part and the other-side fastening part is built up, there is the inconvenience that the earlobe is pressed with a greater than required force, resulting in pain being felt. On the other hand, in order to avoid pain due to the increase of the grasping pressure, when the grasping pressure of the one-side fastening part and the other-side fastening part is lowered, there is inconvenience in that the attitude of the ornament can not be held properly during attaching, thereby reducing the beautiful appearance, and the earring can not be prevented from slipping off the ear, resulting in loss.

SUMMARY OF THE INVENTION

In order to overcome one or more of the above-mentioned inconveniences, the present invention relates to an earring wherein a fastener includes a substantially U-shaped connecting part with one side coupled with a first fastening part on the side of an ornamentation part and the other side coupled with a second fastening part provided in a grasping position opposite to the first fastening part, and an earlobe is grasped between the first fastening part and the second fastening part, characterized in that the connecting part is directed nearly in the vertical direction and provided to grasp the earlobe and a shape and/or a direction of the ornamentation part and/or the fastener are different in conformance with the shape of the earlobe. In the present invention, since the shape and/or direction of an ornamentation part and/or a fastener are varied in conformance with the shape of an earlobe, an earring can be made to look beautiful when viewed from the front and the appearance is improved. Also the earring can be easily attached to or detached from the earlobe and does not become a hindrance when clothes are put on or taken off. Further, since unnecessary pressure due to a spring or the like is not applied to the earlobe using a substantially U-shaped connecting part, pain in the earlobe due to grasping can be reduced.

In order to overcome one or more of the above-mentioned inconveniences, another aspect of the present invention is an earring wherein a personal ornament is provided, and a fastener includes a one-side fastening part provided on one side of a substantially U-shaped connecting part and an other-side fastening part provided on the other side of the connecting part, and the ornament is attached at least to one of the one-side fastening part and the other-side fastening part, and an earlobe is grasped between the one-side fastening part and the other-side fastening part, characterized in that a one-side slipping preventing surface and an other-side slipping preventing surface with a large coefficient of friction are formed at least on the one-side fastening part and the other-side fastening part of the fastener, respectively. In an earring of the present invention, since a one-side sliding preventing surface and an other-side sliding preventing surface with a large coefficient of friction are formed respectively at least at a one-side fastening part and an other-side fastening part of a fastener, the slide prevention of the one-side fastening part and the other-side fastening part in contact with each earlobe surface of an earlobe can be executed and the earring can be attached securely to the earlobe without increasing the grasping pressure created by the one-side fastening part and the other-side fastening part.

Other objects and purposes of the invention will be apparent to persons familiar with structures of this general type upon reading the following specification and inspecting the accompanying drawings.

DETAILED DESCRIPTION

Embodiments of the present invention will be described in detail based on the attached drawings. FIGS. 1 to 12 show a first embodiment of the present invention.

Figure 1A:
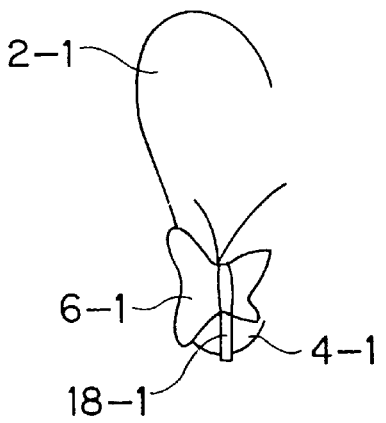
FIG. 1(*a*) is a front view of a first embodiment wherein an earring is attached to a right ear, and FIG. 1(*b*) is a front view of a first embodiment wherein an earring is attached to a left ear.
Figure 1B:
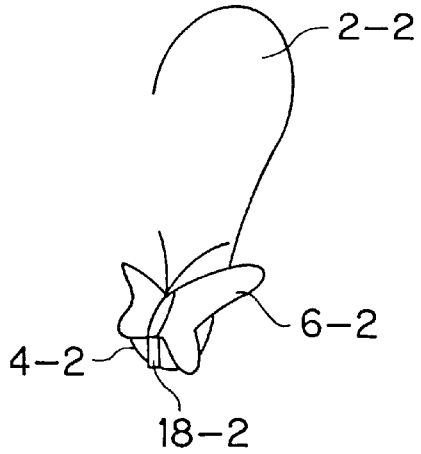

In FIGS. 1(*a*) and (*b*), numerals 2-1, 2-2 designate a right ear and a left ear of a human body. The right ear 2-1 and left ear 2-2 are usually different from each other in rising angles or the like to a right earlobe 4-1 and a left earlobe 4-2 with respect to the front respectively. Therefore, in the first embodiment, a right-ear earring 6-1 to be attached to the right ear 2-1 and a left-ear earring 6-2 to be attached to the left ear 2-2 are made different in shape or attaching direction respectively.

Figure 2:
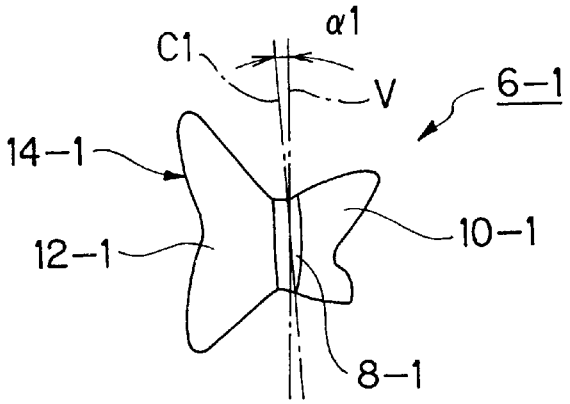
FIG. 2 is a front view of a right-ear earring.

The right-ear earring 6-1 as shown in FIG. 2 includes a right-ear ornamentation part 14-1 having a right-ear center member 8-1, a right-ear one-side ornamentation member 10-1 and a right-ear other-side ornamentation member 12-1 formed into a prescribed shape. The right-ear earring 6-1 also includes a right-ear fastener 22 having a right-ear first fastening part 16 connecting the right-ear ornamentation part 14-1, a U-shaped right-ear connecting part 18 and a right-ear second fastening part 20. The right-ear one-side ornamentation member 10-1 and the right-ear other-side ornamentation member 12-1 are formed into such a shape as to mate with the shape of the right ear 2-1. The right-ear first fastening part 16 and the right-ear second fastening part 20 are opposite to each other. In the right earring 6-1, the center C1 of the right-ear center member 8-1 is inclined at a prescribed first angle $\alpha 1$ with respect to a vertical line V, and the right-ear connecting part 18 is directed in the vertical direction and attached to the right earlobe 4-1.

Figure 3:
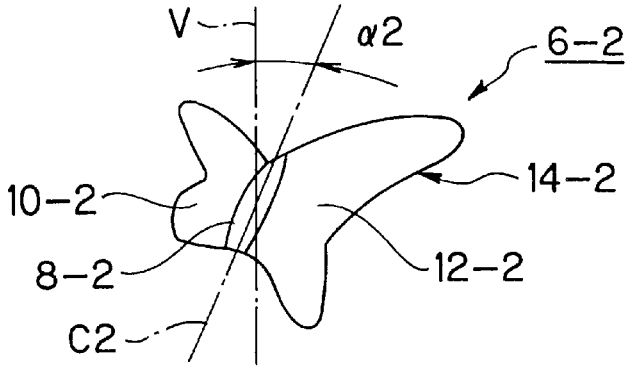
FIG. 3 is a front view of a left-ear earring.
Figure 4:
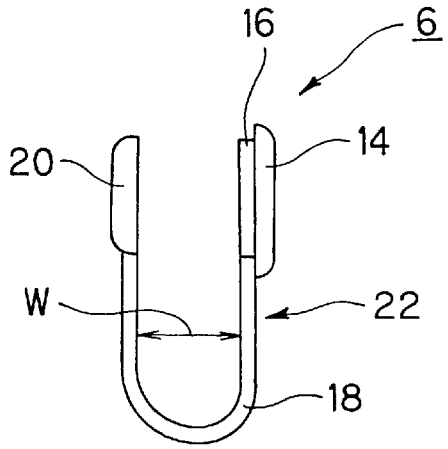
FIG. 4 is a side view of an earring.
Figure 5:
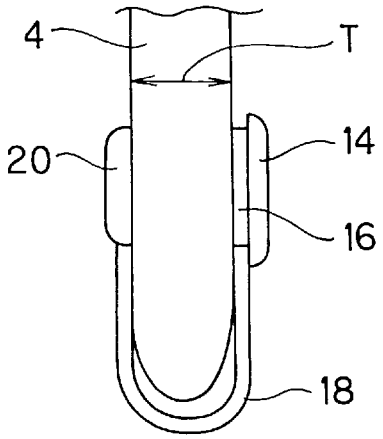
FIG. 5 is a side view of an earring attached to an earlobe.

FIGS. 4 and 5 show a single earring construction that represents both a right and left earring construction with one being the mirror image of the other. The differences between the right and left earrings are shown in FIGS. 2 and 3. Hence, similar fastener parts have the same reference numerals with respect to right and left earrings.

The left-ear earring 6-2 as shown in FIG. 3 includes a left-ear ornamentation part 14-2 having a left-ear center member 8-2, a left-ear one-side ornamentation member 10-2 and a left-ear other-side ornamentation member 12-2 formed into a prescribed shape. The left-ear earring 6-2 also includes a left-ear fastener 22 having a left-ear first fastening part 16 connecting a left-ear ornamentation member 14-2, a U-shaped left-ear connecting part 18 and a left-ear second fastening part 20.

Also in the left-ear earring 6-2, the center C2 of the left-ear center member 8-2 is inclined at a second angle $\alpha 2$ larger than the above-mentioned first angle $\alpha 1$ relative to the vertical line V. The left-ear connecting part 18 extends in the vertical direction and is attached to the left earlobe 4-2. The left-ear one-side ornamentation member 10-2 and the left-ear other-side ornamentation member 12-2 are formed to be different in shape relative to the right-ear one-side ornamentation member 10-1 and the right-ear other side ornamentation member 12-1. The left-ear other-side ornamentation member 12-2 conforms with the shape of the left ear 2-2. The left-ear first fastening part 16 and the left-ear second fastening part 20 are opposite to each other.

As shown in FIGS. 4 and 5, a connecting part 18 for the right ear and the left ear is formed in a prescribed width W so as to limit the tightening to a thickness T of the earlobe 4. The connecting part is also elastic.

Figure 7:
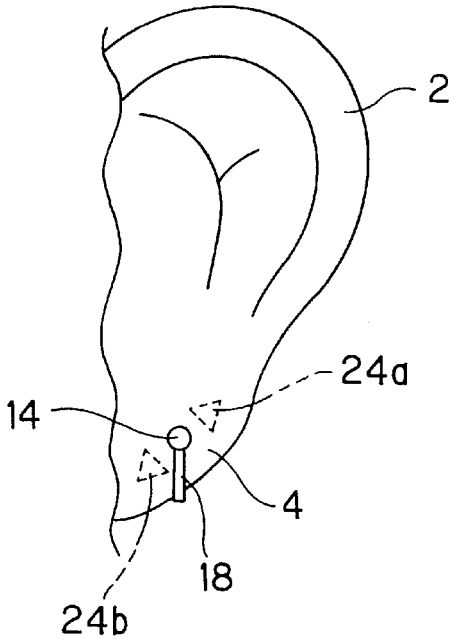
FIG. 7 is a diagram explaining the state where an earring is attached to an earlobe of tapered type.
Figure 8:
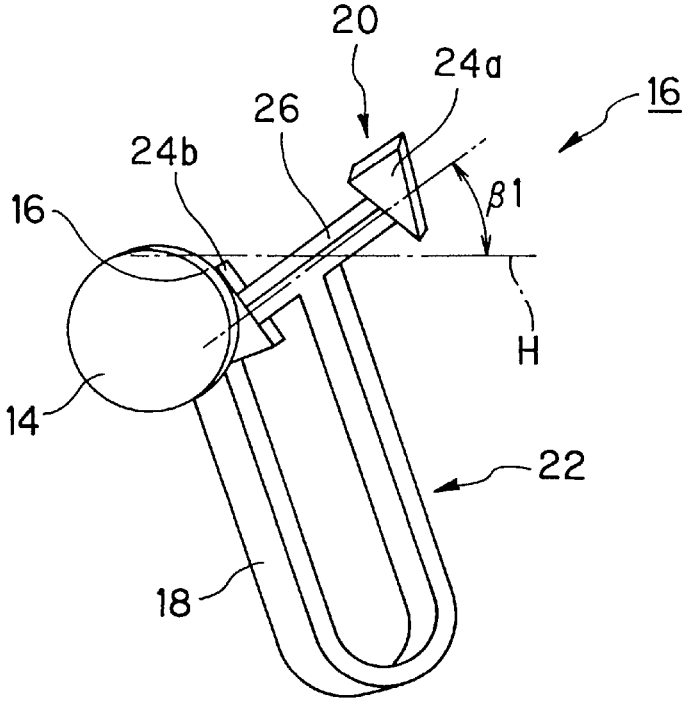
FIG. 8 is a perspective view of the earring in FIG. 7.
Figure 9:
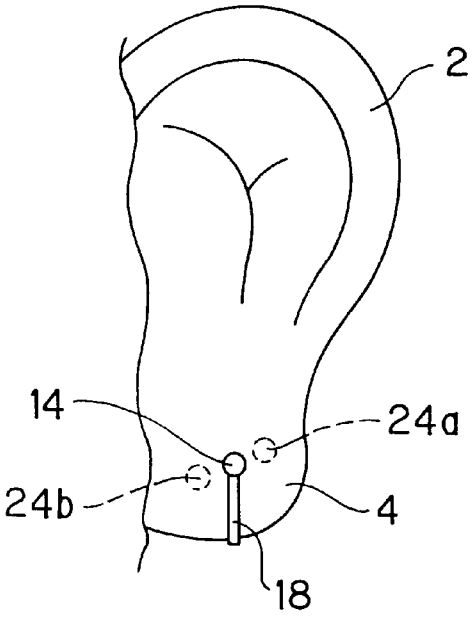
FIG. 9 is a diagram explaining the state where an earring is attached to an earlobe of horizontal type.
Figure 10:
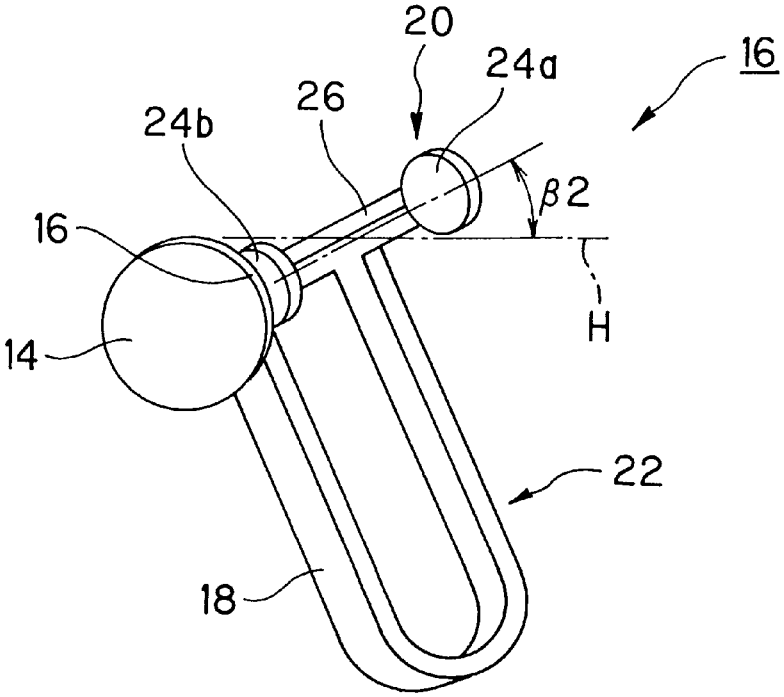
FIG. 10 is a perspective view of the earring in FIG. 9.
Figure 11:
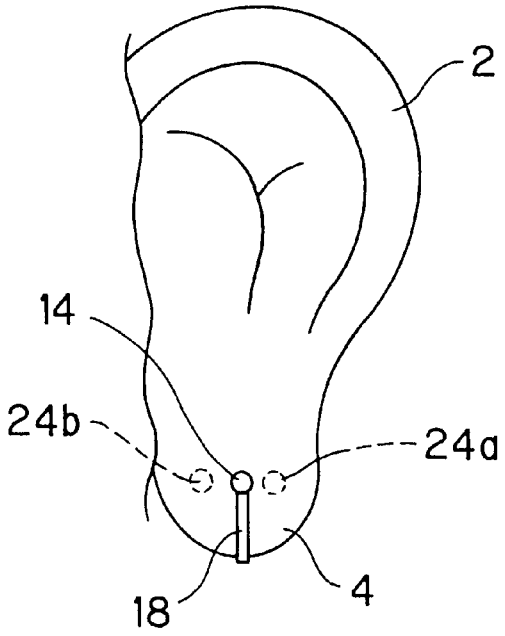
FIG. 11 is a diagram explaining the state where an earring is attached to an earlobe of suspension type.
Figure 12:
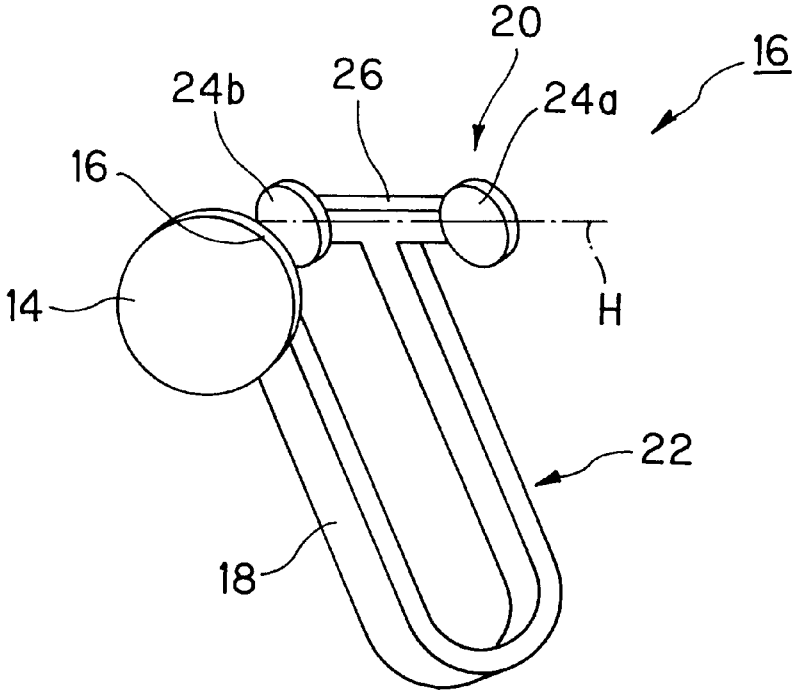
FIG. 12 is a perspective view of the earring in FIG. 11.
Figure 13A:
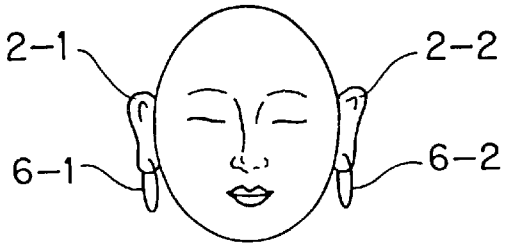
FIG. 13(*a*) is a front view of the second embodiment where earrings are attached to a right ear and a left ear, and FIG. 13(*b*) is a plan view from the upper side of the second embodiment where earrings are attached to a right ear and a left ear.
Figure 13B:
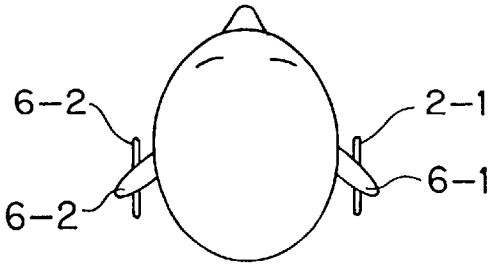
Figure 14:
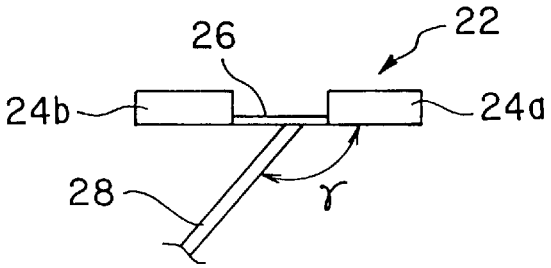
FIG. 14 is a diagram showing the state where a ring body is coupled with a fastener in a prescribed angle.
Figure 15:
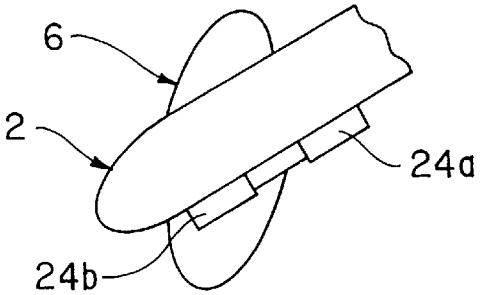
FIG. 15 is an enlarged diagram showing the state where an earring is attached to a portion of a left ear.
Figure 16:
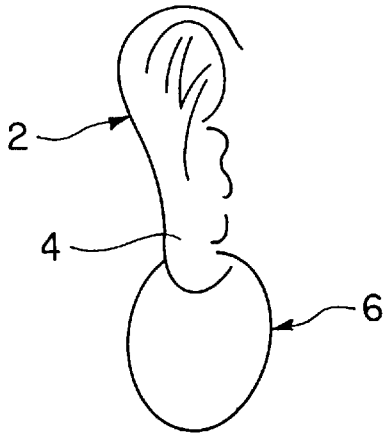
FIG. 16 is a side view showing the state where an earring is attached to a right ear.
Figure 17:
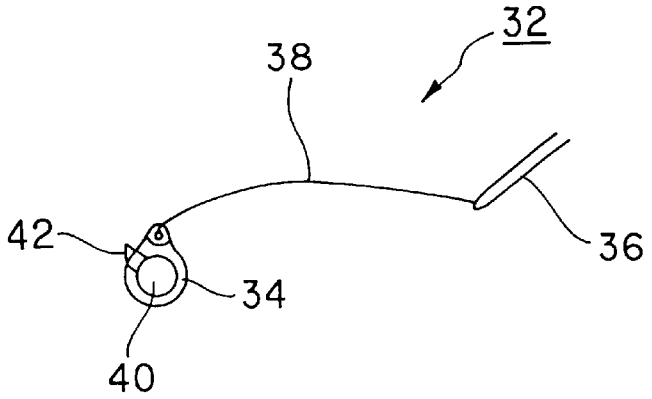
FIG. 17 is a diagram showing a loss prevention device in the third embodiment.
Figure 18:
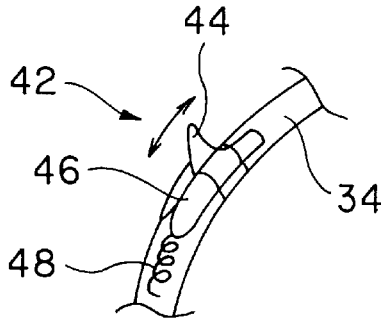
FIG. 18 is an enlarged diagram of a locking operation portion of a ring joint body.

In the first embodiment, as shown in FIGS. 7 to 12, a second fastening part 20 is separated into a first dispersion fastening part 24*a* and a second dispersion fastening part 24*b*, both of which are coupled with each other through a coupling part 26 connected to the connecting part 18. The first and second dispersion fastening parts 24*a*, 24*b* are formed into a triangular shape and are inclined at a first angle $\beta 1$ with respect to a horizontal line H. The dispersion fastening parts 24*a*, 24*b* conform to the shape of each earlobe 4 when the earlobe 4 has a tapered shape, for example as shown in FIGS. 7 and 8. The first and second dispersion fastening parts 24*a*, 24*b* are formed into a circular shape and inclined in the second angle $\beta 2$ with respect to the horizontal line H when the earlobe 4 has a horizontal shape, for example as shown in FIGS. 9 and 10. The first and second dispersion fastening parts 24*a*, 24*b* are further formed into a circular shape and positioned on the horizontal line H when the earlobe 4 is in a suspension shape as shown in FIGS. 11 and 12.

Next, the function of the first embodiment will be described.

Figure 6:
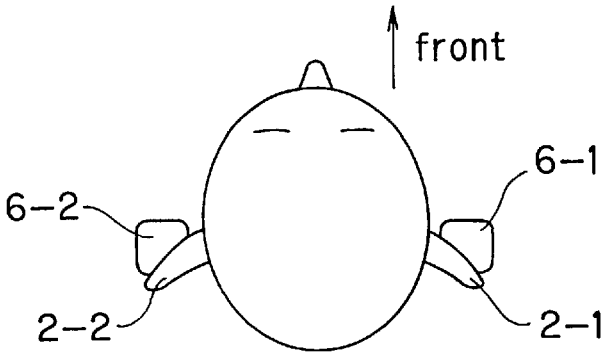
FIG. 6 is a plan view from the upper side of a human head wherein earrings are attached to the right ear and the left ear.

The right ear 2-1 is equipped with the right-ear earring 6-1 with the right-ear connecting part directed in the vertical direction, while the left ear 2-2 is equipped with the left earring 6-2 with the left-ear connecting part direction in the vertical direction. Then as shown in FIG. 1 and FIG. 6, the right-ear earring 6-1 and the left-ear earring 6-2 face the front, whereby the right-ear earring 6-1 and the left-ear earring 6-2 can be made to look beautiful when viewing from the front and the beautiful appearance thereof is improved.

Also, since the connecting part 18 for the right ear and the left ear is formed in a U-shape, a part in contact with a lower side of the earlobe 4 is not liable to be in contact with the outside and there is no fear that the earring becomes a hindrance when clothes are put on or taken off. During attaching, the earring is fitted to the lower side with the earlobe 4 lightly pulled to the outside, and during detaching, the earring is lightly pulled, whereby the convenience for use can be improved when the earring is attached or detached. Further, since the connecting part 18 for the right ear and the left ear has light elasticity, the grasping ability to the earlobe 4 can be improved.

Further, since the connecting part 18 for the right ear and the left ear is formed in the U-shape, an increased pressure does not act on the ear and complications of a pain, tumor, sores and the like are not liable to occur.

Also, since the first fastener 16 and the second fastener 20 are made flat, the appearance is made beautiful and there is no fear that the earring becomes a hindrance when clothes are put on or taken off. Further, if the first fastener 16 and the second fastener 20 are provided with adhesive material comprising an acrylic adhesive, hydrocolloid high molecular compound or the like, strong grasping to the earlobe 4 becomes possible. Also unnecessary pressure is not applied to the earlobe due to the substantially U-shaped connecting part, thus pain of the earlobe due to grasping can be reduced.

FIGS. 13 to 16 show a second embodiment of the present invention.

In the following embodiment, parts executing the same function as that of the above-mentioned first embodiment shall be designated by the same reference numerals and include the above description.

The second embodiment is characterized in that earring 6 of a ring type has a fastener 22 separated into a first dispersion fastening part 24*a* and a second dispersion fastening part 24*b*, both of which are coupled with each other through a coupling part 26, and a ring body 28 is connected to the coupling part 26 at an angle $\gamma$ larger than a right angle. According to the second embodiment, the same effect as that of the above-mentioned first embodiment can be obtained, and as shown in FIGS. 13 to 16, the right-ear earring 6-1 and the left-ear earring 6-2 are positioned at an angle of 90° with respect to the surface of the forehead, and even the earring 6 of ring type can be made to look beautiful and the beautiful appearance thereof is improved.

FIGS. 17 to 21 shown a third embodiment of the present invention.

The third embodiment is characterized in that a loss prevention device 32 is provided to prevent an earring 6 from falling to the ground even if the earring 6 falls out of an earlobe 4. The falling/loss prevention device 32 includes a ring joint body 34, a hair fixing body 36 and a coupling wire 38.

The ring joint body 34 is in the form of a ring and forms a through hole 40 and has a locking operation portion 42. The locking operation portion 42 has a moving body 46 coupled with an operation projection 44 and a spring 48 biasing the moving part 46.

Figure 20:
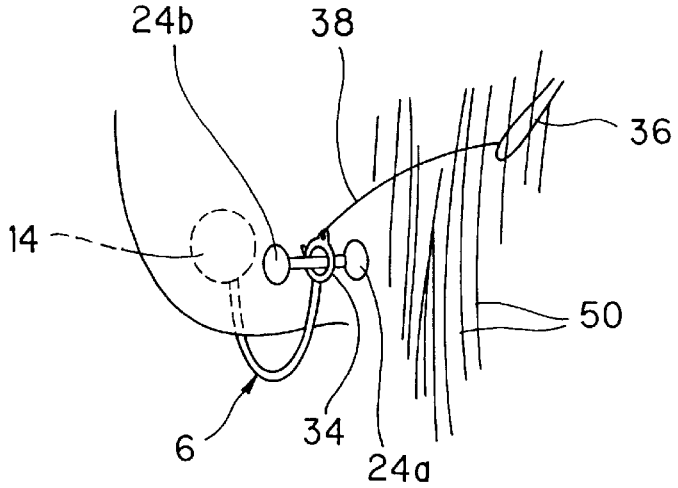
FIG. 20 is a rear elevational view showing the state where an earring with a loss prevention device is attached to an ear.
Figure 21:
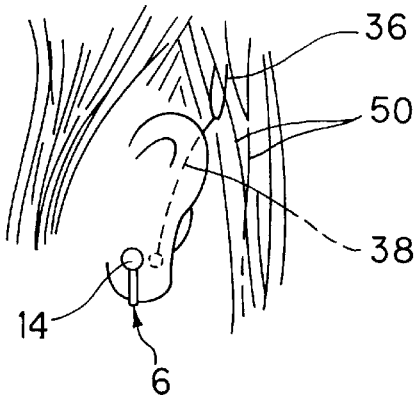
FIG. 21 is a side view showing the state where an earring with a loss prevention device is attached to an ear.
Figure 22:
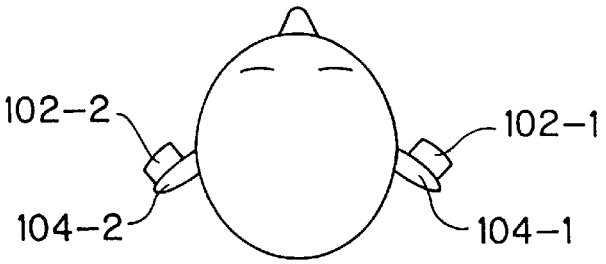
FIG. 22 PRIOR ART
FIG. 22 is a plan view from the upper side of a human head wherein earrings are attached to ears in the prior art.
Figure 23:
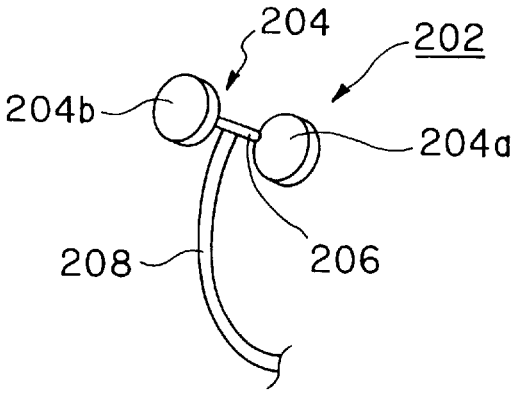
FIG. 23 PRIOR ART
FIG. 23 is a fragmentary perspective view showing a coupling state of a fastener and a ring body in the prior art.
Figure 24:
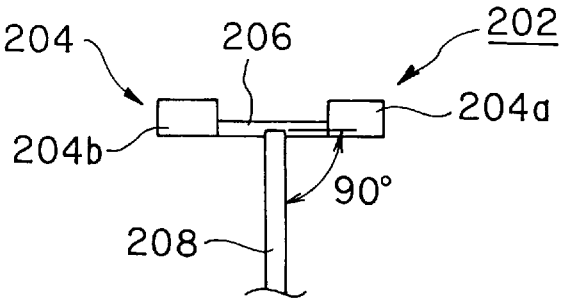
FIG. 24 PRIOR ART
FIG. 24 is a side view showing a coupling state of a fastener and a ring body in the prior art.
Figure 25:
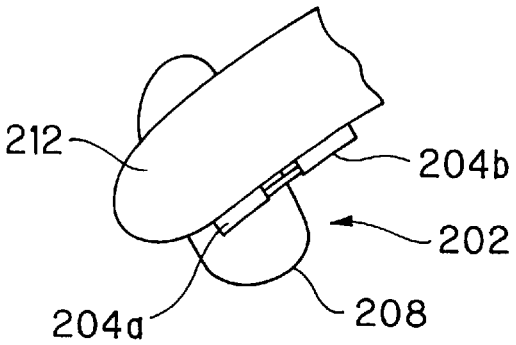
FIG. 25 PRIOR ART
FIG. 25 is an enlarged view showing the state where an earring is attached to a right earlobe in the prior art.
Figure 26:
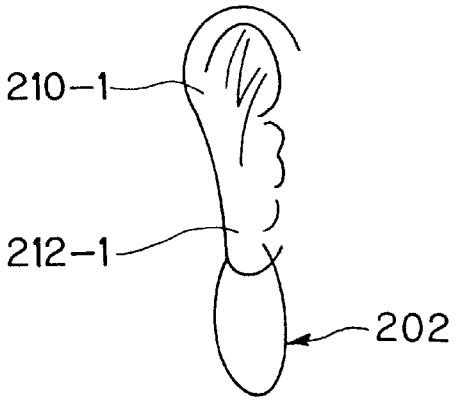
FIG. 26 PRIOR ART
FIG. 26 is a side view showing the state where an earring is attached to a right earlobe in the prior art.
Figure 27:
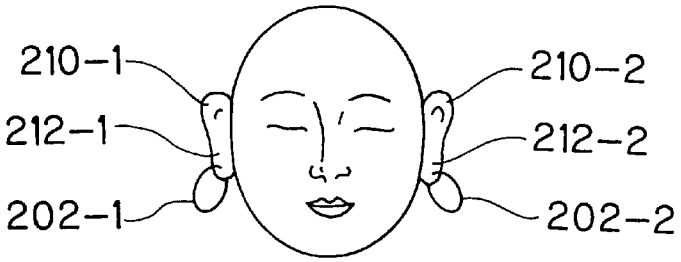
FIG. 27 PRIOR ART
FIG. 27 is a front view showing the state where earrings are attached to a right ear and a left ear.
Figure 28:
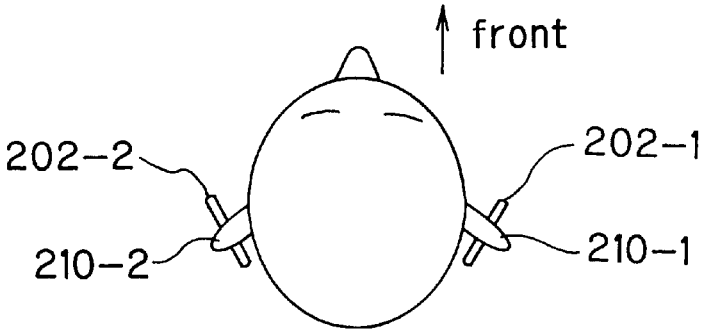
FIG. 28 PRIOR ART
FIG. 28 is a plan view from the upper side of a human head wherein earrings are attached to a right ear and a left ear in the prior art.

The hair fixing body 36 is a hair engaging member, for example a hairpin, and can be locked to hairs 50 as shown in FIGS. 20 and 21.

The coupling wire 38 is soft and thin, and can be made of material such as tungsten, nylon, or polypropylene.

Figure 19:
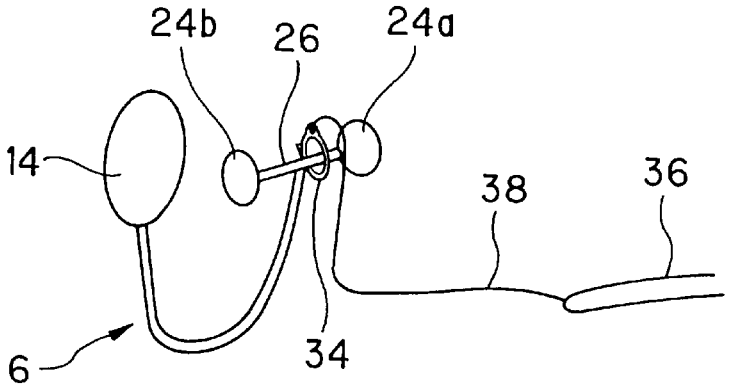
FIG. 19 is a diagram showing the state where a loss prevention device is attached to an earring.

According to the constitution of the third embodiment, as shown in FIGS. 19 to 21, the ring joint body 34 of the falling/loss prevention device 32 is locked to the earring 6 and the earring 6 is attached to the ear 2. The hair fixing body 36 is attached to the hairs, so that even if the earring 6 gets out of the ear 2, the earring 6 is prevented from falling to the ground due to the coupling wire 38 and the hair fixing body 36. Therefore, the fear that an ornamentation part 14 of high price could be lost or broken is reduced.

As clearly understood from the above description, according to the present invention, a connecting part coupling a first fastening part and a second fastening part of an earring extends generally in the vertical direction and is provided to grasp an earlobe, and shape and/or a direction of an ornamentation part and/or a fastener are made different in conformance with shape of the earlobe, whereby the earrings on the right ear and the left ear can be made to look beautiful when viewed from the front and the beautiful appearance of the earrings and wearer are improved. The earring can be easily attached or detached and there is no fear that it becomes a hindrance when clothes are put on or taken off. Also since the connecting part is formed to be substantially U-shaped, unnecessary pressure is not applied to the earlobe and therefore pain in the earlobe due to grasping can be reduced.

Figure 29:
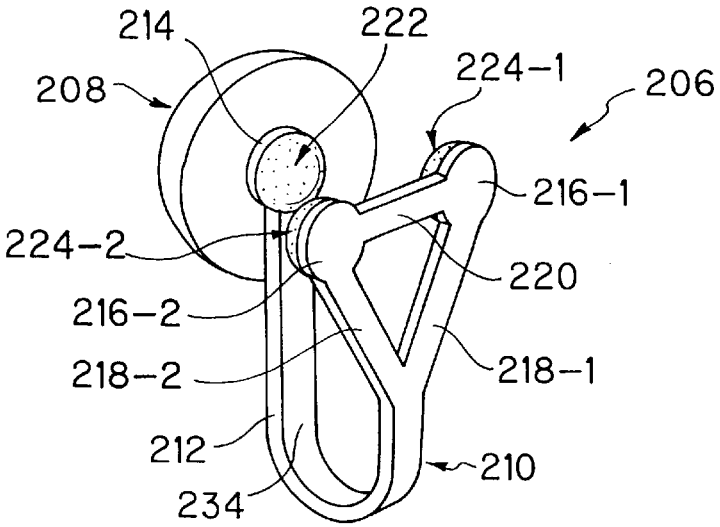
FIG. 29 is a perspective view of an earring showing a fourth embodiment of the invention.
Figure 30:
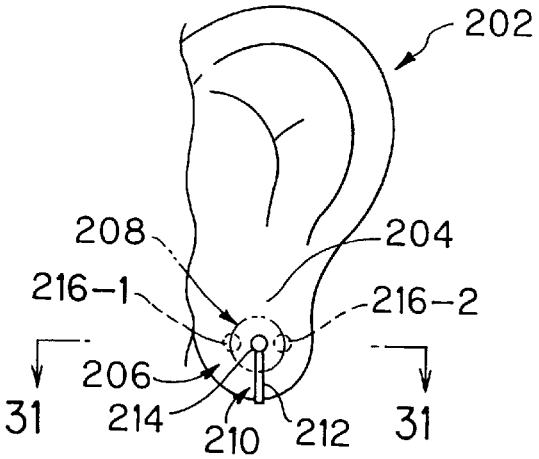
FIG. 30 is a front view of an ear explaining the attaching state thereof to an earlobe.
Figure 31:
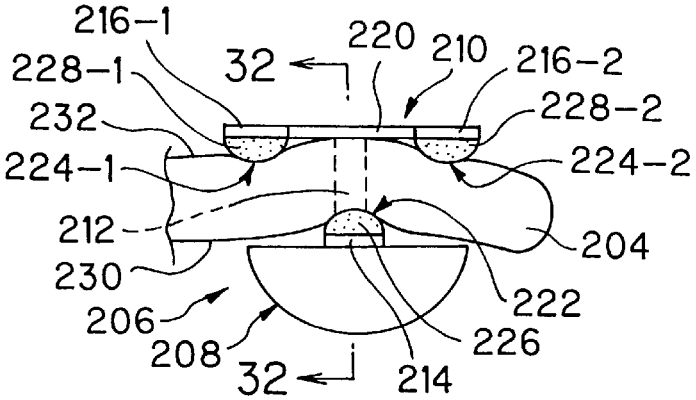
FIG. 31 is an enlarged sectional view taken on line 31—31 of FIG. 30.
Figure 32:
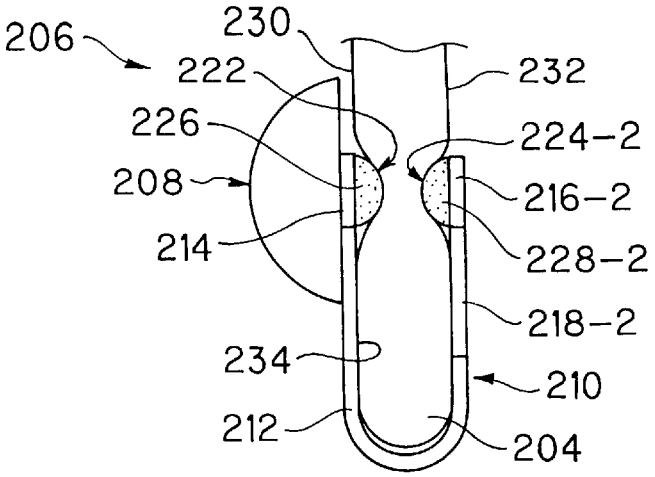
FIG. 32 is a sectional view taken on line 32—32 of FIG. 31.

FIGS. 29 to 35 show a fourth embodiment of the present invention. In FIGS. 30 to 32, numeral 202 designates an ear, numeral 204 designates an earlobe, and numeral 206 designates an earring. The earring 206 has a personal ornament 208 and a fastening 210 attaching the ornament 208 to the earlobe 204.

The ornament 208, which is made of jewels such as diamond, noble metals such as gold and platinum, or imitations such as a glass ball, has various colors and shapes.

Figure 33:
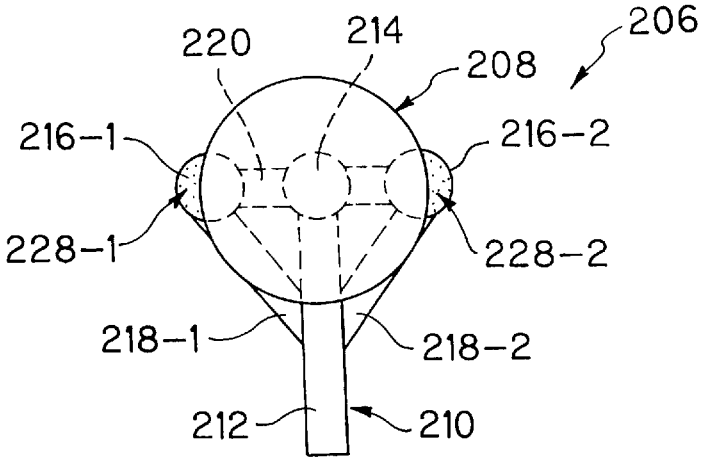
FIG. 33 is a front view of an earring.
Figure 34:
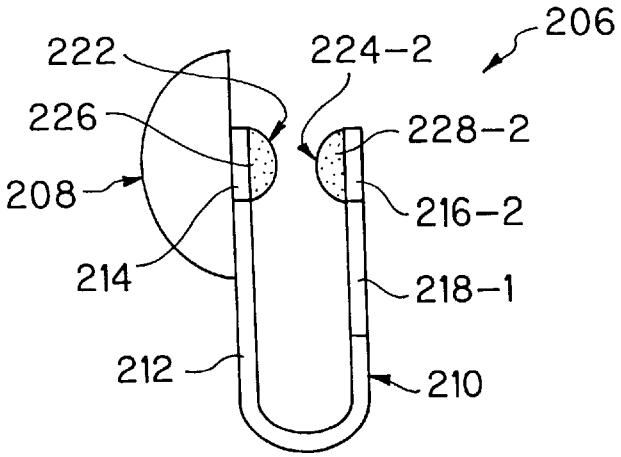
FIG. 34 is a side view of an earring.
Figure 35:
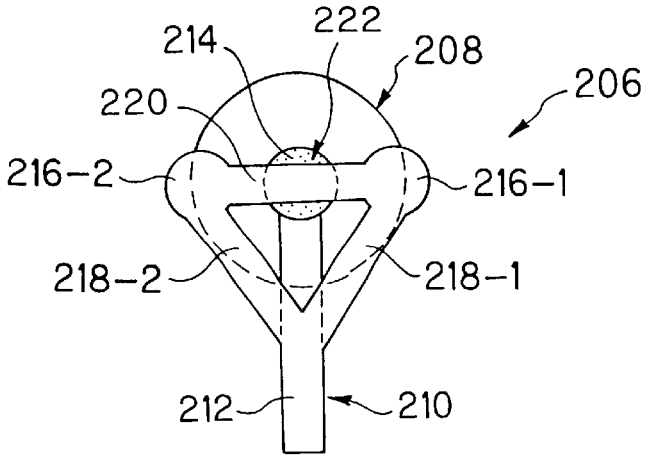
FIG. 35 is a rear elevation of an earring.

The fastener 210, as shown in FIGS. 33 to 35, is provided with a substantially U-shaped connecting part 212 made of an alloy having a shape memory, elastic material or the like and a one-side fastening part 214 is provided on one side or end of the connecting part 212, while an other-side fastening part 216 is provided on the other side or end. The fastener 210, in this embodiment, has the one-side fastening part 214 on one end of the connecting part 212, and the two other-side first and second fastening parts 216-1, 216-2 on the other end where each grasping position is biased so as not to be coincident with the grasping position of one-side fastening part 214. The first fastening part 214 is positioned between the two other-side fastening parts 216-1, 216-2. An interval between the one-side fastening part 214 and the two other-side first and second fastening parts 216-1, 216-2 is set to conform to the thickness of the earlobe 204 so that the grasping pressure acting on the earlobe 204 is substantially constant.

The other side of the connecting part 212 is branched into other-side first and second branch parts 218-1, 218-2, the branch ends of which receive the other-side first and second fastening parts 216-1, 216-2, respectively. The other-side first and second fastening parts 216-1, 216-2 are caused to communicate and connect with each other by a communicating part 220.

The ornament 208 is attached at least to one of the one-side fastening part 214 and other-side fastening part 216. The ornament 208, in this embodiment, is attached to the one-side fastening part 214. Thereby the earring 206 as formed is shown in FIG. 34.

The earring 206 has a one-side slipping preventing surface 222 and an other-side slip prevention surface 224 with a large coefficient of friction formed at least at the one-side fastening part 214 and the other-side fastening part 216 of the fastener 210, respectively.

In this embodiment, a spherical one-side projection part 226 and other-side first and second projection parts 228-1, 228-2 made of gold or ceramic project inwardly from the inward sides of the one one-side fastening part 214 and the two other-side first and second fastening parts 216-1, 216-2 toward opposite sides of the earlobes 204. Fine uneven portions are formed on the surface of the one-side projection part 226 and the other-side first and second projection parts 228-1, 228-2, so that the one-side slip prevention surface 222 and the other-side first and second slip prevention surfaces 224-1, 224-2 with a large coefficient of friction are formed respectively.

Next, the function of this embodiment will be described.

When the earring 206 is attached to the earlobe 204, the earlobe 204 is held by fingers and pulled lightly to thin the earlobe, and then the one-side fastening part 214 and the other-side first and second fastening parts 216-1, 216-2 of the fastener 210 are attached to the earlobe 204 in the thinned state. The earlobe 204 with the fastener 210 attached thereto is returned to its natural thickness when the fingers' grip is released. The one side slipping preventing surface 222 and the other-side first and second slipping preventing surfaces 224-1, 224-2 are in contact with the one-side earlobe surface 230 and the other-side earlobe surface 232 of the earlobe 204 respectively, so that the fastener 210 grasps the earlobe 204.

Then as shown in FIG. 31, the earlobe 204 is bent and grasped by the one-side projection part 226 of the one-side fastening part 214 and the other-side first and second projection parts 228-1, 228-2 of the two other-side first and second fastening parts 216-1, 216-2. The grasping position of the two other-side first and second fastening parts 216-1, 216-2 are biased so as to not be aligned or coincident with the grasping position of the one-side fastening part 214. The one-side fastening part 214 is located between the other-side fastening parts 216-1, 216-2. Also since the earlobe 204, as shown in FIG. 30, is grasped by the one-side fastening part 214 and the two other-side first and second fastening parts 216-1, 216-2 in the grasping position with the one-side fastening part 214 and the two other-side fastening parts 216-1, 216-2 not being coincident, the grasping pressure is exerted in a dispersed manner on the earlobe.

The earring 206 is provided such that the one-side slip prevention surface 222 and the other-side first and second slip prevention surfaces 224-1, 224-2 with a large coefficient of friction are formed on the one-side fastening part 214 and the other-side first and second fastening parts 216-1, 216-2 of the fastener 210, respectively.

Thereby, the earring 206 attached to the earlobe 204 prevents slippage of the one-side fastening part 214 and the other-side first and second fastening parts 216-1, 216-2 which are in contact with the one earlobe surface 230 and the other earlobe surface 232 of the earlobe 204. The earring 206 is securely attached to the earlobe 204 without increasing the grasping pressure due to the one-side fastening part 214 and the other-side first and second fastening parts 216-1, 216-2.

Therefore, the earring 206 can be securely attached to the earlobe 204 without increasing the grasping pressure due to the one-side fastening part 214 and the other-side first and second fastening parts 216-1, 216-2 of the fastener 210. The earring falling off can be prevented without suffering a pain due to attachment of the earring to the earlobe with an increased grasping pressure. The attitude of the ornament 208 can be maintained properly due to the good attaching feeling, and the beautiful appearance is improved.

Moreover, the earring 206 can be attached compactly to the rear side of the earlobe 204 such that the other-side first and second fastening parts 216-1, 216-2 do not project largely away or outwardly from the earlobe, and the beautiful appearance can be improved.

In addition, in this embodiment, although the one-side slip prevention surface 222 and the other-side slip prevention surface 224 with a large coefficient of friction are formed respectively at the one-side fastening part 214 and the other-side fastening part 216 of the fastener 210, a slip prevention surface 234 with a large coefficient of friction may be formed also on the inside of the connecting part 212 of the fastener 210 as shown in FIG. 29. The earring 206 with the slip prevention surface 234 formed not only at the one-side fastening part 214 and the other-side fastening part 216 of the fastener 210 but also on the connecting part 212 can increase the slip prevention effect due to the one-side fastening part 214, the other-side first and second fastening parts 216-1, 216-2 in contact with the one-side earlobe surface 230 and the other-side earlobe surface 232 of the earlobe 204 and the connecting part 212. The earring 206 can be further attached securely to the earlobe 204 without increasing the grasping pressure applied by the one-side fastening part 214 and the other-side first and second fastening parts 216-1, 216-2 to the earlobe.

Therefore, since the earring 206 can be securely attached to the earlobe 204 without increasing the grasping pressure of the fastener 210, the falling off of the earring can be prevented without suffering pain due to the attaching of the earring utilizing an increased pressure. Further, the attitude of the ornament 208 can be maintained properly due to a good attachment feeling, and the beautiful appearance is improved.

Figure 36:
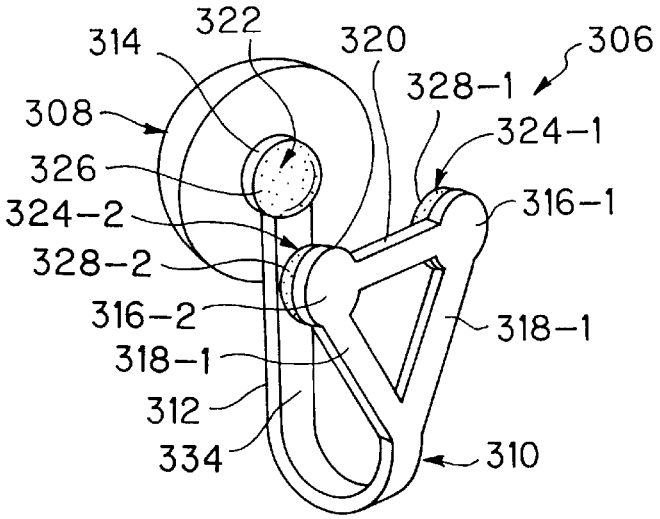
FIG. 36 is a perspective view of an earring showing fifth embodiment of the invention.
Figure 37:
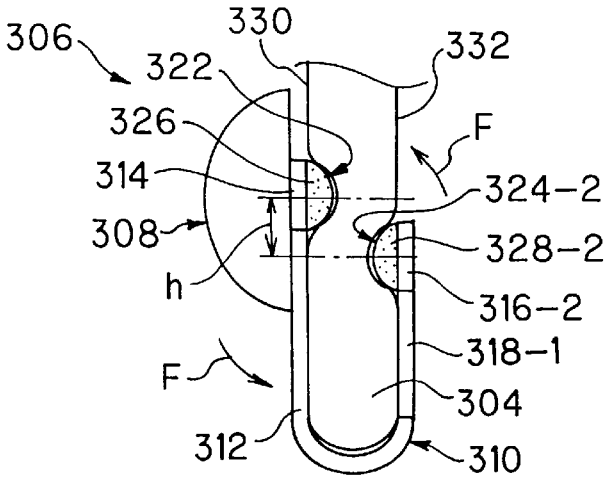
FIG. 37 is a sectional view of an earlobe attaching an earring.

FIGS. 36 and 37 show yet another embodiment of the present invention. Similar parts to the above embodiments are designated by the same reference numerals with the 2XX designation replaced by a 3XX designation. An earring 306 in this embodiment includes a personal ornament 308, and a fastener 310 attaching the ornament 308 to earlobe 304 as shown in FIG. 37. The fastener 310 is provided with a one-side fastening part 314 formed on one side of a substantially U-shaped connecting part 312, and two other-side first and second fastening parts 316-1, 316-2 formed on the other side thereof. The grasping positions of the first and second fastening parts 316-1, 316-2 are positioned offset or non-coincident with the grasping position of the one-side fastening part 314. The other-side projecting parts 328-1, 328-2 are positioned closer to the closed portion of the U-shaped connecting part 312.

The other side of the connecting part 312 is branched into other-side first and second branching parts 318-1, 318-2. The branch ends of the first and second branching parts 318-1, 318-2 are provided with the other-side first and second fastening parts 316-1, 316-2, respectively. The other-side first and second fastening parts 316-1, 316-2 are caused to communicate with each other by a communicating part 320 and the ornament 308 is attached to the one-side fastening part 314.

The earring 306 has the one-side fastening part 314 and the other-side first and second fastening parts 316-1, 316-2 are respectively provided with a one-side projecting part 326 and other-side first and second projecting parts 328-1, 328-2. A one-side slip prevention surface 322 and other-side first and second slip prevention surfaces 324-1, 324-2 with a large coefficient of friction are formed on the respective projecting parts 326, 328-1 and 328-2.

In the earring 306 in this embodiment, the one-side fastening part 314 on one side of the substantially U-shaped connecting part 312 and the other-side first and second fastening parts 316-1, 316-2 on the other side of the connecting part 312 differ by height h in the vertical direction (FIG. 37).

Next, the function will be described. In the earring 306 as shown in FIG. 37, when the ornament 308 is attached to the one-side fastening part 314 positioned on the front side or outside of the earlobe 304 during attaching, the one-side fastening part 314 is lowered due to the weight imbalance and may slip off the ear.

A force F in the direction of lowering the one-side fastening part 314 and raising the other-side fastening part 316 is exerted on the fastener 310 of the earring 306 with respect to the earlobe 304. In the earring 306 of this embodiment, since the one-side fastening part 314 on one side of the connecting part 312 and the other-side first and second fastening parts 316-1, 316-2 on the other side of the connecting part 312 are provided at different heights, the difference being height h in the vertical direction, the force F is utilized to prevent the earring from slipping off the ear. The one-side fastening part 314 and the other-side first and second fastening parts 316-1, 316-2 are pressed onto the one-side earlobe surface 330 and other-side earlobe surface 332 of the earlobe 304 respectively, thereby executing the slippage prevention. That is, the earring 306 in this embodiment can convert the force F generated due to the weight imbalance into the grasping pressure and can be prevented from slipping off the ear.

Therefore, the earring 306 in this embodiment can be further prevented from slipping off in comparison with the previous embodiment and can be attached securely.

In addition, although the fastener 310 in each embodiment as above described is provided with the one-side fastening part 314 on one side of the connecting part 312 and the two other-side first and second fastening parts 316-1, 316-2 on the other side of the connecting part 312 with each grasping position of the other-side fastening parts 316-1, 316-2 being positioned so as not to be coincident or aligned with the grasping position of the one-side fastening part 314, the invention should not be limited to this specific structure.

Figure 38:
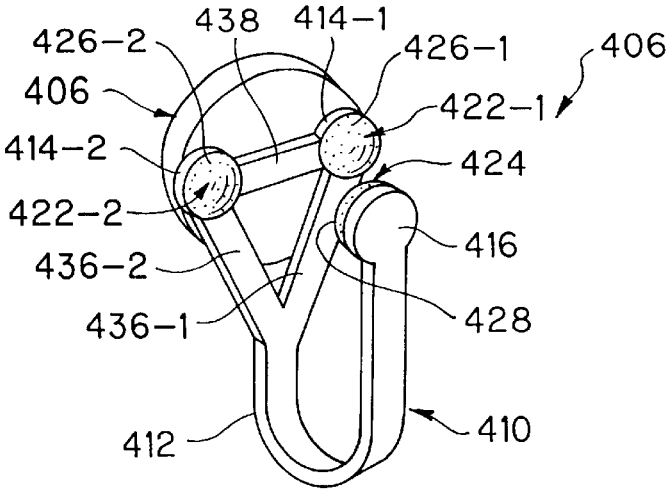
FIG. 38 is a perspective view of an earring showing a first modification of a fastener.

For example, in fastener 410 as shown in FIG. 38, one end side of a connecting part 412 is branched into two one-side branching parts 436-1, 436-2, on which two one-side fastening parts 414-1, 414-2 are provided. Similar parts to the above embodiments are designated with similar reference numerals, however, the 3XX designation is replaced by the 4XX designation. The two one-side branching parts 436-1, 436-2 are caused to communicate with each other by a communicating part 438, and the other-side fastening part 416 may be provided with its grasping position biased so as to not be coincident or being nonaligned with each grasping position of the two one-side fastening parts 414-1, 414-2.

Figure 39:
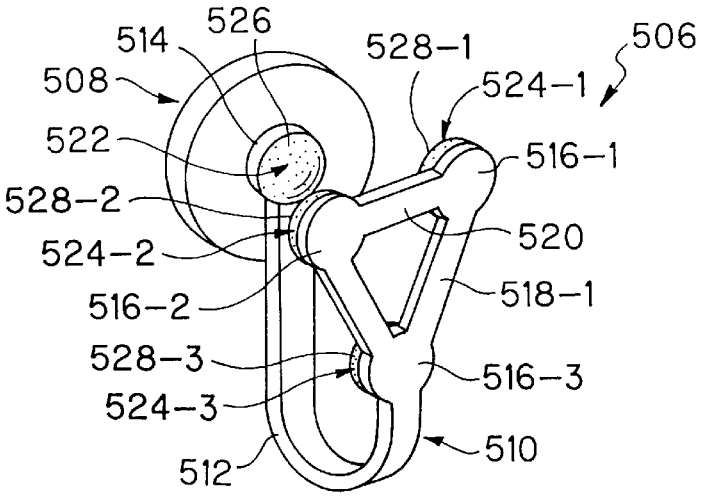
FIG. 39 is a perspective view of an earring showing a second modification of a fastener.

Also in a fastener 510 as shown in FIG. 39, a one-side fastening part 514 is provided on one side of a connecting part 512, and three other-side first to third fastening parts 516-1, 516-2, 516-3 may be provided on the other side of the connecting part 512. Each grasping position of the other-side fastening parts 516-1, 516-2, 516-3 are positioned offset or biased so as not to be coincident with the grasping position of the one-side fastening part 514.

Figure 40:
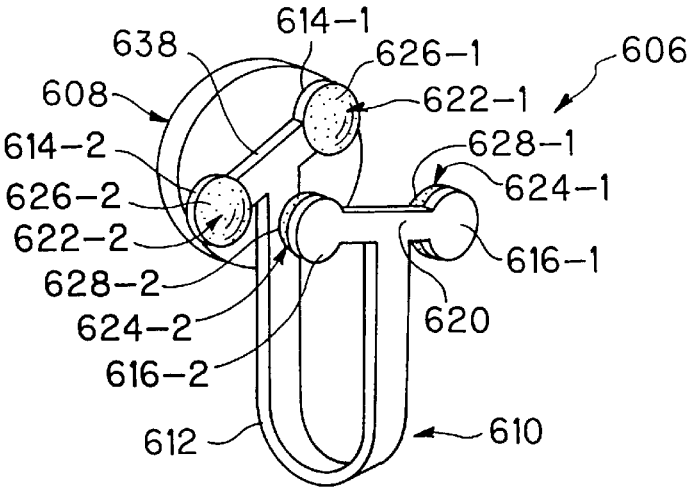
FIG. 40 is a perspective view of an earring showing a third modification of a fastener.

Further in a fastener 610 as shown in FIG. 40, two one-side fastening parts 614-1, 614-2 may be provided on one side of a connecting part 612 by a communicating part 638, and two other-side fastening parts 616-1, 616-2 may be provided on the other side of the connecting part 612 by a coupling part 620. Each grasping position of the other-side fastening parts 616-1, 616-2 are positioned offset or biased so as not to be coincident with the grasping positions of the two one-side grasping parts 614-1, 614-2.

Also in the earring 206, 306, 406, 506, 606 of the embodiments as above described, although the ornament is attached to the one-side fastening part 214, 314, 414, 514, 614 of the fastener, the ornament may be attached not only to the one-side fastening part 214, 314, 414, 514, 614 but also to the other-side fastening part 216, 316, 416, 516, 616. In an alternative, an integral ornament may continue from the one-side fastening part 214, 314, 414, 514, 614 to the other-side fastening part 216, 316, 416, 516, 616.

Since the earring is attached with the earlobe grasped by the fastener 210, 310, 410, 510, 610, the ornament may be attached to the earlobe by reversing the position of the ornament between the front side and the rear side, so that the ornamentality and the practicality of the earring is increased.

The earring of the present invention can prevent slipping of a one-side fastening part and an other-side fastening part in contact with respective earlobe surfaces of an earlobe, and can be securely attached to the earlobe without increasing the grasping pressure due to the one-side fastening part and the other-side fastening part. Therefore, the earring can be securely attached to the earlobe without increasing the grasping pressure due to the one-side fastening part and the other-side fastening part, and can be prevented from slipping off the ear without suffering pain due to the attaching, and can properly maintain the attitude of the ornament due to the good attaching feeling and can improve the beautiful appearance.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a pair of earrings including first and second earrings each for attachment to one of a pair of earlobes, each said first and second earring including an ornament and a substantially U-shaped connecting part having one end coupled to a first fastening part adjacent said ornament and the other end coupled to a second fastening part disposed opposite said first fastening part to grasp an earlobe therebetween, comprising the improvement wherein:

said connecting parts of said first and second earrings are oriented in a substantially vertical direction when attached to an earlobe, and each said ornament of said first and second earrings includes an elongate center member which extends therealong and defines a longitudinal axis thereof, said longitudinal axis of said ornament of said first earring is disposed at a first angle with respect to said connecting part of said first earring, said longitudinal axis of said ornament of said second earring is disposed at a second angle with respect to said connecting part of said second earring, and said second angle being greater than said first angle such that said first and second earrings are non-symmetrical relative to one another to compensate for differences in shape between the pair of earlobes and to correctly orient said ornaments on the earlobes when viewed from the front.

2. The pair of earrings of claim 1 wherein said second fastening parts each include a pair of fastening bodies configured for engagement with an outer surface of the respective earlobe, said fastening bodies being arranged such that a straight line intersecting said pair of fastening bodies is disposed at a third angle with respect to the corresponding said connecting part, said third angle being selected such that said fastening bodies are locatable in positions which conform to a particular shape of the earlobe.

3. The pair of earrings of claim 1 wherein an overall shape of said ornament of said first earring differs from an overall shape of said ornament of said second earring to compensate for differences in shape between the pair of earlobes.

4. The pair of earrings of claim 1 wherein said connecting parts of said first and second earrings are constructed of a material having at least some elasticity to enable grasping of a corresponding one of the earlobes therebetween.

5. The pair of earrings of claim 1 wherein said connecting parts of said first and second earrings each include a front leg and a rear leg closely spaced from one another to enable positioning on a corresponding one of the earlobes so as to prevent snagging of the respective earring on objects.

* * * * *